US005981031A

United States Patent [19]

Vogt et al.

[11] Patent Number: 5,981,031

[45] **Date of Patent: *Nov. 9, 1999**

[54] POLYMERIC MEMBRANE COMPRISING POROUS AGGLOMERATES OF HYDROPHOBIC THERMOPLASTIC MATERIAL

[75] Inventors: Jürg Vogt, Luzern; Hansrudolf Unold, Kerns, both of Switzerland

[73] Assignee: Sarna Patent- und Lizenz-AG, Sarnen, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/425,073

[22] Filed: Apr. 19, 1995

[30] Foreign Application Priority Data

Apr. 19, 1994 [CH] Switzerland ..... 01 177/94

[51] Int. Cl.[6] ..... B32B 5/18; B32B 3/10

[52] U.S. Cl. ..... 428/147; 428/175; 428/308.4; 428/317.1; 428/327; 428/521; 428/523

[58] Field of Search ..... 428/521, 523, 428/147, 144, 175, 240, 245, 327, 403, 407, 262, 306.6, 143, 308.4, 317.1

[56] References Cited

U.S. PATENT DOCUMENTS 4,684,568 8/1987 Lou ..... 428/265
5,310,590 5/1994 Tochacek et al. ..... 428/102

FOREIGN PATENT DOCUMENTS 1244845 9/1971 United Kingdom .

*Primary Examiner*—Hoa T. Le
*Attorney, Agent, or Firm*—Burns, Doane, Swecker & Mathis, L.L.P.

[57] ABSTRACT

The inventive polymeric membrane has the feature that porous agglomerates of at least one powder of hydrophobic thermoplastic material, formed by influence of heat, are fixed onto at least one side of a carrier material or of a mixture of carrier materials by a mechanical anchoring in the carrier material and/or by an adhering onto the carrier material.

Also a method of producing of this polymeric membrane and its use are described.

25 Claims, 3 Drawing Sheets

POLYMERIC MEMBRANE COMPRISING POROUS AGGLOMERATES OF HYDROPHOBIC THERMOPLASTIC MATERIAL

BACKGROUND OF THE INVENTION

1. Field of the Invention

The present invention relates to a polymeric membrane, a method of producing this polymeric membrane and its use as well.

2. Description of the Prior Art

In the prior art there exist two groups of polymeric membranes which can be applied as subroof membranes, also called underlay membrane or "pliable sarking and underlays" or "underslating".

The representatives of the first group are predominantly based on a basis of polyvinylchloride containing a plasticizing agent and display generally a thickness between 0.5 and 1.0 mm. They have the advantage of being able to be welded by means of hot air or heating wedge apparatuses.

However, they have among others the drawback that their permeability regarding water vapor is generally considerably lower than 40 g/m$^2$ day (23° C., 90% relative humidity). Therefore, high demands must be posed regarding the quality of workmanship when laying the membrane. Similarly, the application at roof constructions with a high inherent humidity is generally problematic.

The representatives of the second group contain no uniform material basis. Their main feature is that due to very fine pores with partly clearly above 100 g/m$^2$d (23° C., 90% relative humidity) they display extremely high permeabilities regarding water vapor. The products of this group are generally thinner than 0.5 mm. The drawback of these polymeric membranes is that partly due to the low thickness of the material, partly due to the used duroplastic raw materials, they can not be welded together at conditions present at a building site.

Therefore, subroofs having no seams cannot be produced, with the consequence that these subroofs can fulfill the function of an emergency covering only un-completely.

Connections of such subroof membranes to polymeric waterproofing and roofing membranes on flat roofs at the transition from sloping roofs to flat roofs are intrinsic regarding the execution.

SUMMARY OF THE INVENTION

It is an object of the present invention to unite the advantages of both groups of products described above in one single new product. Specifically a subroof membrane shall be provided which features a high permeability regarding water vapor and is weldable at building site conditions, as well.

It is a further object of the present invention to provide a polymeric membrane which does not contain any plasticizing agents, no halides, no polyvinylchloride, no bitumen and no heavy metals, such as lead and cadmium.

This new polymeric membrane shall also be arbitrarily combinable and lend itself to be connected by bonding or heat-sealing (welding) to a polymeric waterproofing and roofing membrane, such as for instance described in the European Patent Specification No. 0 428 851 B1, or with a vapor barrier on the basis of polyolefines, such as defined for instance in a Swiss Patent Application, filed at the same time and setting a date of priority (Apr. 19th 1994), having the title "Polymeric membrane which prevents the diffusion of water vapor or at least reduces it substantially".

It is a further object of the present invention to provide a polymeric membrane which can be handled easy in its application and processing.

This polymeric membrane shall preferably be also translucent.

This polymeric membrane shall be composed on the basis of low cost raw materials and shall be producable by means of low cost methods.

This new polymeric membrane shall also be able to be fixed onto board shaped materials which serve for the thermal insulation and/or sound protection and/or fire protection.

The raw materials shall be selected in such a manner that the polymeric membrane produced by these materials can be recycled, specifically together with the polymeric waterproofing and roofing membrane mentioned above and the vapor barriers mentioned above.

The invention is defined by the features in the independent claims.

Preferred embodiments are defined in the dependent claims.

The inventive polymeric membranes meet the above objects.

The inventive polymeric membranes have among others the quite important advantage that they feature a high water vapor permeability.

Preferred polymeric membranes are also weldable at conditions prevailing at a building site—in contrast to laboratory conditions or industrial weldings.

By this it will become possible to adjust the quality of the embodiment to the demands made for the subroof and accordingly always present a proper solution with the same product for prevailing conditions of quite differing expositions of climates.

Because the inventive polymeric membranes contain no plasticizing agents, all problems, which can occur due to the loss of plasticizing agents or the migration of plasticizing agents, are done away with. Also, no production of fumes during the welding occurs.

The inventive polymeric membranes contain no halides, no polyvinylchloride, no bitumen and no heavy metals, such as lead and cadmium.

Practically no emissions occur during the production or laying.

The membrane is recyclable. The disposing by burning or storing in a dump is harmless.

Therefore, the inventive polymeric membranes are ecologically harmless.

Preferably, the inventive polymeric membrane is translucent.

Thus, markings on the support or supporting structure remain visible. Thus, the application is simplified.

For the shaping of specific details, such as necessary e.g. at chimneys, ventpipes or lightning protection apparatuses, prefabricated shaped parts can be welded on or the desired shapes can be produced from the subroof membrane or an other membrane having a similar raw material basis, e.g. Sarnafil T$^R$, by a corresponding heating, twisting and welding together.

The processing of the inventive polymeric membrane can proceed in various ways. The inventive polymeric membranes can be welded together by means of hot air or heating wedge apparatuses either by machine or manually. They can, however, also be connected together by suitable adhesive tapes or bonding agents, e.g. of poly-isobutylene. For corresponding applications an overlapping, scale like laying of the membranes is possible, too, without that they must be connected together.

The inventive production method allows to produce from low-cost raw materials a product of excellent properties. This results in an excellent price/performance ratio.

Furthermore, the inventive production method allows in a most simple way the placing of hot-melt adhesives onto the polymeric membrane. By means of this, elements, which comprise already several function layers and can be layed quite economically, can be prefabricated by machine with little expenditures by laminating the membrane onto e.g. thermal insulating boards.

The inventive polymeric membranes are used preferably as subroof membranes.

BRIEF DESCRIPTION OF THE DRAWINGS

The present invention will be better understood and objects other than those set forth above, will become apparent when consideration is given to the following description when read in conjunction with the appended drawings.

In FIGS. 1 to 5 the inventive polymeric membranes are applied as single layers.

In FIGS. 6 to 11 the inventive polymeric membranes are fixed onto a board shaped material (composite elements).

Figure 2:
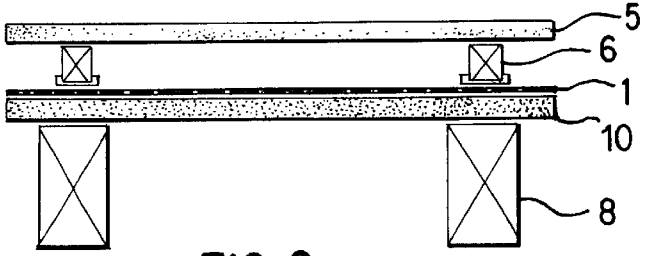
In FIGS. 1 to 11 sections through typical roof structures are shown in which inventive polymeric membranes are used.
Figure 1:
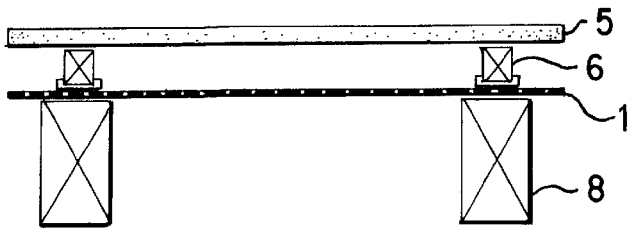
Figure 4:
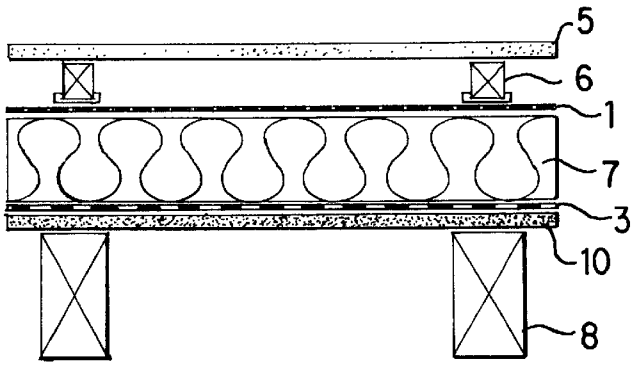
Figure 3:
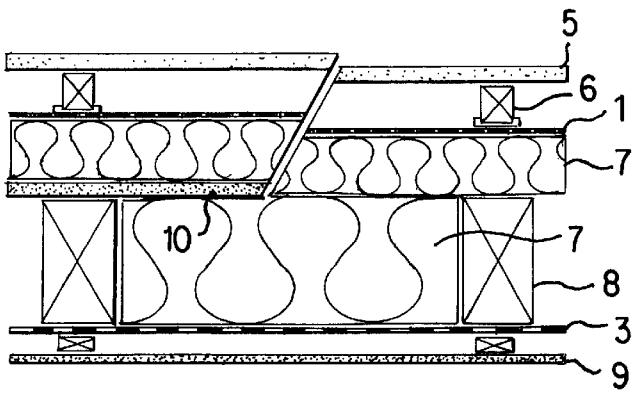
Figure 6:
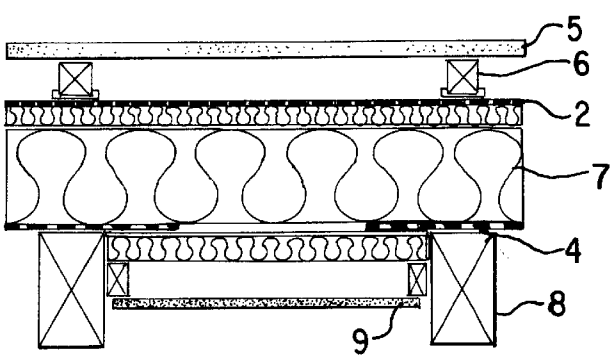
Figure 8:
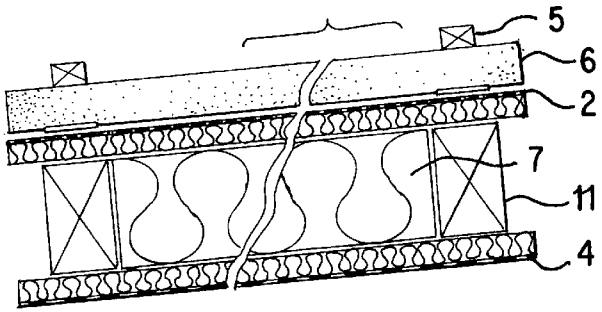
Figure 5:
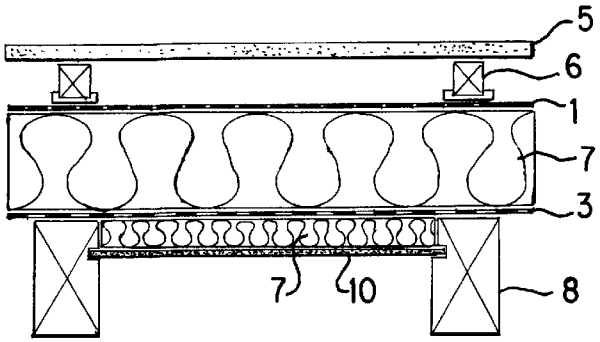
Figure 7:
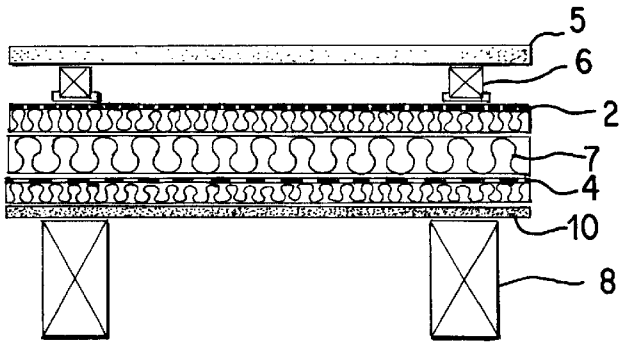
Figure 10:
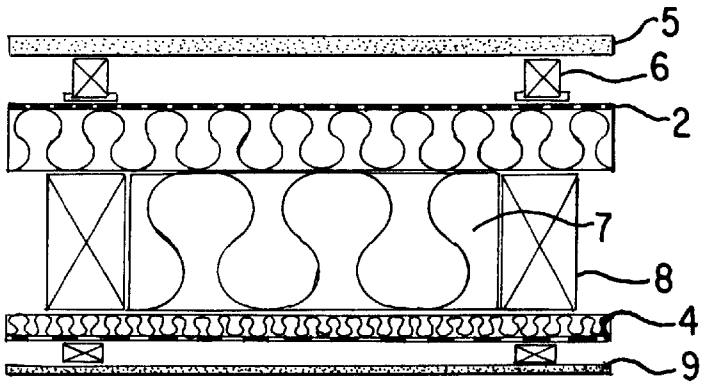
Figure 11:
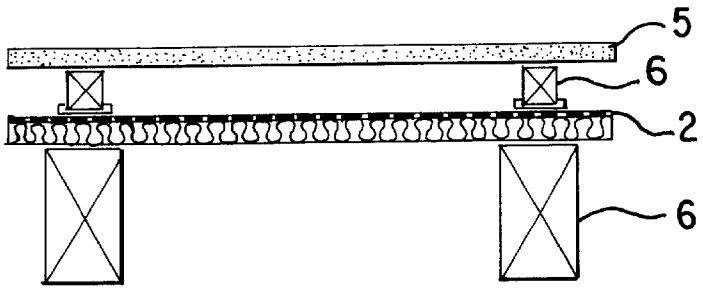
Figure 9:
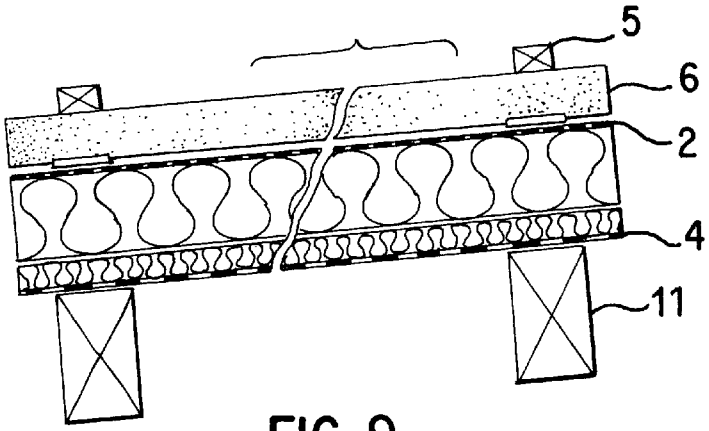

Thereby, the following reference numerals are used:

1 inventive polymeric membrane.

2 inventive polymeric membrane, fixed onto a board shaped material.

3 vapor barrier, preferably such a vapor barrier which is defined in the Swiss patent application with the title "polymeric membrane, which prevents the diffusion of water vapor or at least reduces it substantially", which was filed at the same time and sets a priority date (Apr. 19th 1994).

4 vapor barrier analogue to reference numeral 3, fixed onto a board shaped material.

5 batten.

6 counter batten.

7 thermal insulation.

8 rafters.

9 cladding.

10 continous roof planking.

11 purlin.

DETAILED DESCRIPTION OF THE PREFERRED EMBODIMENT

A polymeric membrane according to the invention contains porous agglomerates of at lest one powder of hydrophobic thermoplastic material, formed by influence of heat, fixed onto at least one side of a carrier material or of a mixture of carrier materials by a mechanical anchoring in the carrier material and/or by an adhering onto the carrier material.

The invention includes a polymeric membrane wherein the powder of hydrophobic thermoplastic materials is a homo- or copolymeric polyolefine or a mixture of homo- or copolymeric polyolefines.

The invention includes a polymeric membrane wherein at least one of the used powder of hydrophobic thermoplastic materials is composed of a polyethylene-homopolymer with a density of 0.899 to 0.940 g/cm$^3$ and/or a copolymer which is composed of the monomer ethylene and a comonomeric vinylester of a $C_2$-to $C_3$-alkane carboxylic acid, whereby the comonomeric portion amounts to 1–30 percent by weight and the ethylene-monomeric portion amounts to 70–99% by weight, whereby by the total of the % by weight is 100, and whereby the melt flow index, abbreviated with MFI, of the above mentioned polymers, measured at 190° C. and 2.16 kg weight, corresponding to DIN 53735, code D lies between 0.1 and 10 g/10 min, preferably between 1 and 5 g/10 min.

The invention includes a polymeric membrane wherein the powder of hydrophobic thermoplastic material contains in a worked in, compounded form at least one component which is selected from the group consisting of color pigments, stabilizers (especially light protection agents), antioxidants, auxiliary materials which reduce the combustibility of the polymeric membrane (e.g., aluminum hydroxide, magnesium hydroxide), and filler materials (especially chalk, kaolin, talcum, and quartz powder).

The invention includes a polymeric membrane wherein the powder of hydrophobic thermoplastic material is mixed with at least one component selected from the group consisting of auxiliary processing agents which increase the flowability of the powder (especially aluminum oxide), and antistatic agents (e.g., calcium stearate and zinc stearate).

The invention includes a polymeric membrane wherein the carrier material or mixture of carrier materials is porous and structured in such a manner, that it ensures the dimensional stability of the polymeric membrane during the prduction process and/or the application of the polymeric membrane, and/or that it ensures the weldability of the polymeric membrane by means of hot air and/or heating wedge, and/or that it ensures the resistance against tearing and the resistance against a continued tearing during application of the polymeric membrane, (epecially a woven fabric, a non-woven fabric, a web or a fleece, or any combination thereof, of plastic and/or glass fibers).

The invention includes a polymeric membrane wherein the carrier material or mixture of carrier materials is structured in such a manner that it itself is water tight up to such a hydrostatic head which amounts to at least 20 percent, preferably at least 50 percent, of the hydrostatic head of the entire polymeric membrane.

The invention includes a polymeric membrane wherein the grain size of at least 65% by weight of the powder of thermoplastic material is in the range of 150 to 500 micrometers, and in that preferably less than 15% by weight of the powder of thermoplastic material have a grain size of more than 400 micrometers.

The invention includes a polymeric membrane wherein its water vapor permeability, measured at 38° C. and a relative humidity of the air of 10% at the dry side of the specimen and 100% at the damp side of the specimen, amounts in accordance with the standards NF H00-044, ASTM E 398-83, JIS K 7129 to 100 to 3000 g/m$^2$ 24 h, preferably to 500 to 1500 g/m$^2$ 24 h.

The invention includes a polymeric membrane wherein an intermediate layer of porous agglomerates improving the adhering to the carrier material is located between the carrier material and an outer layer of porous agglomerates, whereby this intermediate layer is thinner in comparison with the outer layer, and whereby this intermediate layer is composed of a thermoplastic material which in comparison to the thermoplastic material used in the outer layer, has a lower melting point and/or a lower viscosity.

The invention includes a polymeric membrane wherein in case of a coating on one side by said agglomerates said carrier material, and in case of a coating on both sides by said agglomerates one of the two uppermost layers of material of said agglomerates is discontinuously coated at the outer side by at least one hot-melt adhesive, preferably selected from the group of the ethylene vinylacetate-copolymers and the group of the polyamide-copolymers.

The invention includes a polymeric membrane wherein an outermost layer of material of said agglomerates is structured or discontinuously coated at the outer side, so that in the state of use and of application the danger of persons slipping thereon is reduced, whereby a possibly present hot-melt adhesive is not to be located at the same outer side as the anti slipping surface, and where the anti slipping surface is preferably composed of a powder of hydrophobic thermoplastic material and/or non metallic inorganic substances (e.g., quartz sand).

The invention includes a polymeric membrane wherein a foil on the basis of a thermoplastic material is laminated either onto the carrier material or mixture of carrier materials or at least on one uppermost layer of material of the agglomerates, whereby this foil has a water vapor permeability, measured at 38° C. and a relative humidity of air of 10% at the dry side of the specimen and of 100% at the damp side of the specimen, according the standards NF H00-044, ASTM E 398-83, JIS K 7129 of at least 50 g/m$^2$ 24 h, and whereby this foil is not to be located either on a hot-melt adhesive layer or on an anti slipping surface.

The invention includes a polymeric membrane wherein the porous agglomerates are formed of powders of thermoplastic materials which contain 50 to 100% by weight of polyethylene-homo-polymers and/or copolymers, 0 to 10% by weight of color pigments, 0 to 5% by weight of stabilizers, 0–50% by weight of auxiliary materials which reduce the combustibility of the polymeric membrane, and 0 to 25% by weight of fillers, whereby the total of the % by weight amounts to 100.

The invention includes a polymeric membrane wherein a board shaped material which serves preferably for thermal insulation and/or sound protection and/or fire protection is affixed onto one side, preferably by a hot-melt adhesive.

The invention includes a method of producing a polymeric membrane, wherein in a first step a first powder, which contains the respective needed recipe-components and has the desired grain size, is strewn onto a passing carrier material, then, if desired, one or a plurality of (a) further powder (s) with the respective recipe-components and the desired grain sizes are strewn subsequently onto the mentioned first powder, then the product obtained thereby is heated in a second step in such a manner that the individual powder particles are connected to each other to porous agglomerates, further wherein the product obtained thereby is pressed in a third step in a heated state in such a manner between two cylinders that at the one side the desired pore structure is formed and that at the other side the agglomerates are fixed by a mechanical anchoring in the carrier material and/or by an adhearing onto the carrier material, and wherein the product obtained in this matter is colled in a fourth step, and thereafter, if desired, the above steps are repeated for the other side of the carrier material on-line or after a previous winding off-line, and then the polymeric membrane obtained in this manner is wound.

The invention includes a method of producing a polymeric membrane, wherein either a foil on the basis of a thermoplastic material is laminated onto the carrier material passing in the first step, or in the third step the product obtained is pressed together with one of the above mentioned foils between the two cylinders, or after the fourth step one of the above mentioned foils is laminated thereon.

The invention includes a method of producing a polymeric membrane, wherein after the third step either a hot-melt adhesive or the starting material from which the anti-slipping surface is formed, is strewn as a powder onto the desired side of the membrane and thereafter the product obtained is heated in such a manner that at the one side the powder, which has been strewn on, is fixed on the membrane and at the other side the membrane does not begin to melt, and is thereafter colled.

The invention includes a method of producing a polymeric membrane, wherein the polymeric membrane is heated at the side, where the hot-melt adhesive is located, in such a manner that at the one side the hot-melt adhesive melts and at the other side the membrane does not begin to melt, and wherein thereafter the polymeric membrane is united at the side, on which the hot-melt adhesive is located, with a board shaped material, under the influence of pressure and is colled.

The invention includes the use of the polymeric membranes for a sealing of buildings, preferably high-rise buildings, especially as subroof membrane (also termed underlay membrane), or as covering membrane of rear aerated facades, or for wrapping or covering of articles.

The following examples shall illustrate the present invention.

EXAMPLE 1

For the production of a polymeric membrane of a thickness of 1.2 mm, of which the upper layer is structured the same as the lower layer, the proceeding was as follows:

The high pressure-polyethylene-powder (a low density polyethylene) "Coathylene" $^R$ HL 2548 of the company Plast-Labor SA in CH-1630 Bulle/Switzerland was strewn onto a glass fleece with a weight per unit area of 50 g/m$^2$ passing at a speed of 2.2 m/min.

The deposited amount amounted to 350 g/m$^2$.

The product obtained in this way was heated from above in a furnace having a length of 2 m by means of infrared rays up to a temperature of maximal 150° C.

This temperature was measured on the surface of the product by means of a temperature sensor.

The product obtained in this way was led through a calander with two water cooled steel cylinders. The gap between these cylinders amounted to 0.9 mm. The temperature of the polymeric membrane directly ahead of the entry into the gap amounted to 115° C.

This product was led around a cooling cylinder and wound up.

The above steps were repeated for the other side of the polymeric membrane. The speed of the at one side coated membrane amounted thereby to 2.4 m/min.

The temperature reached at by the infrared rays amounted to maximal 145° C.

The gap between the two water cooled steel cylinders amounted to 1.2 mm.

The temperature of the polymeric membrane directly ahead of the entry into the gap amounted to 118° C.

The so prepared polymeric membrane had the following characteristics:

| Test | Standard | Value |
|---|---|---|
| Water vapor permeability | ASTM E 398-83 (38° C., 90%) | 240 g/m$^2$ 24 h |
| longitudinal tearing force | analogue to DIN 53455 with a strip having a width of 5 cm | 450 N/5 cm |
| lateral tearing force | | 365 N/5 cm |
| tear elongation longitudinally | analogue to DIN 53455 with a strip having a width of 5 cm | 2.2% |
| tear elongation laterally | | 2.4% |
| coefficient of elongation longitudinally | internal EMPA-Standard SOP 01'126 | $105 \times 10^{-6}K^{-1}$ |
| coefficient of elongation laterally | | $130 \times 10^{-6}K^{-1}$ |
| resistance against continued tearing longitudinally | DIN 53363 | 191 N/mm |
| resistance against continued tearing laterally | | 214 N/mm |
| burning characteristics number | United Cantonal fire insurance-companies (VKF) | 4.2 |

EXAMPLE 2

In order to produce a polymeric membrane of a thickness of 0.9 mm the procedure was as follows:

The high pressure polyethylene powder, mentioned in example 1, was strewn onto a polyester fine fleece passing at a speed of 2.5 m/min and having a weight per unit area of 40 g/m$^2$.

The deposited amount was 350 g/m$^2$.

The product obtained thereby was heated from above in a furnace having a length of 2 m by means of infrared rays up to a temperature of maximal 130° C.

This temperature was measured on the surface of the product by means of a temperature sensor.

The product obtained therewith as led through a calander with two water cooled steel cylinders. The gap between these cylinders amounted to 0.9 mm.

The temperature of the polymeric membrane directly ahead of the entry into the gap amounted to 115° C.

This product was led around a cooling cylinder and wound up.

The above steps were repeated in an analogue manner for the other side of the polymeric membrane.

Thereby, the hot-melt adhesive Abifor 1605 of the company Billeter Kunststoffpulver AG, CH-8033 Zurich/Switzerland was strewn in an amount of 75 g/m$^2$.

The speed of the passing membrane amounted to 3.5 m/min.

The temperature reached by the infrared rays amounted to maximal 97° C.

The gap in the calander was open.

The so prepared polymeric membrane had the following characteristics:

| Test | Standard | Value |
|---|---|---|
| Water vapor permeability | ASTM E 398-83 (38° C., 90%) | 860 g/m$^2$ 24 h |
| longitudinal tearing force | analogue to DIN 53455 with a strip having a width of 5 cm | 200 N/5 cm |
| longitudinal tear elongation | analogue to DIN 53455 with a strip having a width of 5 cm | 7.5% |
| resistance against continued tearing longitudinally | DIN 53363 | 89 N/mm |
| burning characteristics number | United Cantonal fire insurance companies (VKF) | 4.2 |

The side of this polymeric membrane coated by the hot-melt adhesive was heated by a hot air blower in such a manner, that the hot-melt adhesive melted. The temperature was in the range between 75° C. and 110° C.

The membrane heated in this manner was united continuously with a Sarnaroc Nova mineral fiber board which serves mainly for the thermal insulation, pressed on and cooled.

The product obtained in this manner was cut to the respective desired sizes.

While there are shown and described present preferred embodiments of the invention, it is to be distinctly understood that the invention is not limited thereto, but may be otherwise variously embodied and practiced within the scope of the following claims.

We claim:

1. A polymeric membrane, which comprises porous agglomerates of at least one powder of hydrophobic thermoplastic material, formed by influence of heat, fixed onto at least one side of a carrier material or of a mixture of carrier materials by a mechanical anchoring in the carrier material and/or by an adhering onto the carrier material, said polymeric membrane containing no plasticizing agents, halides, polyvinylchloride, bitumen and heavy metals, wherein the water vapor permeability of said polymeric membrane, measured at 38° C. and a relative humidity of the air of 10% at the dry side of the specimen and 100% at the damp side of the specimen, amounts in accordance with the standards NF HOO-044, ASTM E 398-83, JIS K 7129 to 100 to 3000 g/m$^2$ 24 h.

2. The polymeric membrane according to claim 1, wherein the powder of hydrophobic thermoplastic material is a homo- or copolymeric polyolefine or a mixture of homo- or copolymeric polyolefines.

3. The polymeric membrane according to claim 1, wherein at least one of the powder of hydrophobic thermoplastic materials is composed of a polyethylene-homopolymer with a density of 0.899 to 0.940 g/cm$^3$ and/or a copolymer which is composed of the monomer ethylene and a comonomeric vinylester of a $C_2$-to $C_3$-alkane carboxylic acid, whereby the comonomeric portion amounts to 1–30 percent by weight and the ethylene-monomeric portion amounts to 70–99% by weight, whereby the total of the % by weight is 100, and whereby the melt flow index, abbreviated with MFI, of said polyethylene-homopolymer or said copolymer, measured at 190° C. and 2.16 kg weight, corresponding to DIN 53735, code D lies between 0.1 and 10 g/10 min.

4. The polymeric membrane according to claim 3, wherein said porous agglomerates are formed of powders of thermoplastic materials which contain 50 to 100% by weight of said polyethylene-homopolymer and/or said copolymer, 0 to 10% by weight of color pigments, 0 to 5% by weight of stabilizers, 0–50% by weight of auxiliary materials which reduce the combustibility of the polymeric membrane, and 0 to 25% by weight of fillers, whereby the total of the % by weight amounts to 100.

5. The polymeric membrane according to claim 3, wherein the melt flow index, measured at 190° C. and 2.16 kg weight, corresponding to DIN 53735, code D lies between 1 and 5 g/10 min.

6. The polymeric membrane according to claim 1, wherein the powder of hydrophobic thermoplastic material contains in an incorporated, compounded form at least one component which is selected from the group consisting of color pigments, stabilizers, antioxidants, auxiliary materials which reduce the combustibility of the polymeric membrane and filler materials.

7. The polymeric membrane according to claim 6, wherein the stabilizers are light protection agents, the auxiliary material is aluminum hydroxide or magnesium hydroxide, and the filler materials are selected from the group consisting of chalk, kaolin, talcum and quartz powder.

8. The polymeric membrane according to claim 1, wherein the powder of hydrophobic thermoplastic material is mixed with at least one component selected from the group consisting of auxiliary processing agents which increase the flowability of the powder and antistatic agents.

9. The polymeric membrane according to claim 8, wherein the auxiliary processing agent is aluminum oxide and the antistatic agent is calcium stearate or zinc stearate.

10. The polymeric membrane according to claim 1, wherein said carrier material or mixture of carrier materials is porous and structured in such a manner, that it ensures the dimensional stability of the polymeric membrane during the production process and/or the application of the polymeric membrane, and/or that it ensures the weldability of the polymeric membrane by means of hot air and/or heating wedge, and/or that it ensures the resistance against tearing and the resistance against a continued tearing during application of the polymeric membrane.

11. The polymeric membrane according to claim 10, wherein the carrier material or mixture of carrier materials is a woven fabric, a non-woven fabric, a web or a fleece, or any combination thereof, of plastic and/or glass fibers.

12. The polymeric membrane according to claim 1, wherein said carrier material or mixture of carrier materials is structured in such a manner that it itself is water tight up to such a hydrostatic head which amounts to at least 20 percent of the hydrostatic head of the entire polymeric membrane.

13. The polymeric membrane according to claim 1, wherein the grain size of at least 65% by weight of the powder of thermoplastic material is in the range of 150 to 500 micrometers.

14. The polymeric membrane according to claim 8, wherein less than 15% by weight of the powder of thermoplastic material have a grain size of more than 400 micrometers.

15. The polymeric membrane according to claim 1, wherein an intermediate layer of said porous agglomerates improving the adhering to the carrier material is located between said carrier material and an outer layer of said porous agglomerates, whereby this intermediate layer is thinner in comparison with said outer layer, and whereby this intermediate layer is composed of a thermoplastic material which in comparison to the thermoplastic material, used in the outer layer, has a lower melting point and/or a lower viscosity.

16. The polymeric membrane according to claim 1, wherein in case of a coating on one side by said agglomerates said carrier material is discontinuously coated at the outer side by at least one hot-melt adhesive, or in case of a coating on both sides by said agglomerates one of the two outermost layers of material of said agglomerates is discontinuously coated at the outer side by at least one hot-melt adhesive.

17. The polymeric membrane according to claim 16, wherein a board shaped material is affixed onto one side.

18. The polymeric membrane according to claim 17, wherein said board shaped material serves for thermal insulation and/or sound protection and/or fire protection and is affixed onto one side by said hot-melt adhesive.

19. The polymeric membrane according to claim 16, wherein said hot-melt adhesive is an ethylene vinylacetate-copolymer or a polyamide-copolymer.

20. The polymeric membrane according to claim 1, wherein an outermost layer of material of said agglomerates is structured or discontinuously coated at the outer side, so that in the state of use and of application the danger of persons slipping thereon is reduced, whereby a hot-melt adhesive is not to be located at the same outer side as said anti slipping surface.

21. The polymeric membrane according to claim 20, wherein said anti-slipping surface is composed of a powder of hydrophobic thermoplastic material and/or non metallic inorganic substances.

22. The polymeric membrane according to claim 21, wherein said non metallic inorganic substances is quartz sand.

23. The polymeric membrane according to claim 1, wherein a foil on the basis of a thermoplastic material is laminated either onto said carrier material or mixture of carrier materials or onto at least one outermost layer of material of said agglomerates, whereby this foil has a water vapor permeability, measured at 38° C. and a relative humidity of air of 10% at the dry side of the specimen and of 100% at the damp side of the specimen, according the standards NF HOO-044, ASTM E 398-83, JIS K 7129 of at least 50 g/m$^2$ 24 h, and whereby this foil is not to be located either on a hot-melt adhesive layer or on an anti slipping surface.

24. The polymeric membrane according to claim 1, wherein the carrier material or mixture of carrier materials is structured in such a manner that it itself is water tight up to such a hydrostatic head which amounts to at least 50 percent of the hydrostatic head of the entire polymeric membrane.

25. The polymeric membrane according to claim 1, wherein its water vapor permeability, measured at 38° C. and a relative humidity of the air of 10% at the dry side of the specimen and 100% at the damp side of the specimen, amounts in accordance with the standards NF HOO-044, ASTM E 398-83, JIS K 7129 to 500 to 1500 g/m$^2$ 24 h.

* * * * *